US005333322A

United States Patent [19]

Weir

[11] Patent Number: 5,333,322

[45] Date of Patent: Aug. 2, 1994

[54] ADD-ON SEAT MODULE FOR SWIMMING POOL

[75] Inventor: Donald H. Weir, York, Pa.

[73] Assignee: Fox Pool Corporation, York, Pa.

[21] Appl. No.: 947,443

[22] Filed: Sep. 21, 1992

[51] Int. Cl.[5] ..... E04H 4/04

[52] U.S. Cl. ..... 4/496; 4/578.1/567

[58] Field of Search ..... 4/492, 496, 499, 501, 4/503, 504, 507, 508, 509, 510, 511, 512, 528, 531, 538, 513, 537, 541, 546, 559, 567, 568, 584, 589, 590, 591, 579, 494; 297/14

[56] References Cited

U.S. PATENT DOCUMENTS

| | | | |
|---|---|---|---|
| 1,824,396 | 5/1930 | Erhard et al. | 4/579 |
| 3,837,016 | 9/1974 | Schindler et al. | 4/172 |
| 3,952,338 | 4/1976 | Troxclair | 4/172.15 |
| 4,052,757 | 10/1977 | Dotson | 4/172.17 |
| 4,221,008 | 9/1980 | Nolan | 4/496 |
| 4,238,859 | 12/1980 | Badon, Jr. | 4/492 |
| 4,248,255 | 2/1981 | Arrowsmith | 4/496 |
| 4,371,003 | 2/1983 | Goguen | 137/625.46 |
| 4,468,822 | 9/1984 | McKay | 4/488 |
| 4,765,542 | 8/1988 | Carlson | 4/602 |
| 4,837,869 | 6/1989 | Simmon | 4/496 |
| 4,930,168 | 6/1990 | Ferlise | 4/489 |

OTHER PUBLICATIONS

Tallman One Piece Fiberglass Pools–Pool & Spa News, Leisure Publications, Inc., Los Angeles, Calif.; May 4, 1992, p. 97.

*Primary Examiner*—Henry J. Recla
*Assistant Examiner*—Gregory Vidovich
*Attorney, Agent, or Firm*—Arthur J. Plantamura

[57] ABSTRACT

A modular seat unit devised to be lowered into and secured to the perimeter wall at the shallow end of a swimming pool is provided. The modular seat unit affords a swimming pool owner with an in-pool seating accessory which is conveniently attached to a swimming pool wall and used by an occupant while still in the swimming pool. The pre-formed seating module is devised to include hydrotherapy water/air jets to produce pressurized, therapeutic water turbulence and includes conveniently accessible means for controlling the water flow to the seat cavity. An adapter to hold the pole of an umbrella to shelter the seat's occupant from the sun's rays is integrated into the module.

13 Claims, 5 Drawing Sheets

ADD-ON SEAT MODULE FOR SWIMMING POOL

The invention relates to a seat module which may be conveniently used with a pre-existing swimming pool. More particularly, the modular seat unit of the invention comprises a seating element that is a retrofitted accessory which is lowered into a swimming pool and attached on the vertical wall at the shallow end of the pool and with the seat facing toward the interior of the pool. The invention may be used in any of a wide variety of swimming pools including those formed from a plurality of contiguously joined modular wall panels wherein one or more of the wall panels may be modified so as to optionally accommodate means to secure the seat module in position in the swimming pool.

BACKGROUND OF THE INVENTION

The availability of a means to permit a swimmer to rest in a comfortable sitting position in a stable seat within a swimming pool has become increasingly desirable especially for more elderly swimmers who desire to rest temporarily while still remaining in the swimming pool. While it is of course possible to lower a chair or stool into the swimming pool as a seating means, this is awkward and generally uncomfortable and unsatisfactory and, sometimes, even hazardous when the seat becomes dislodged. Various schemes devised to afford seating arrangements within or adjacent to the pool, such as those chair units shown in U.S. Pat. Nos. 4,468,822 and 4,837,869, or arrangements that comprise a therapy unit (which may include a seating arrangement ), have been proposed. Other arrangements previously tried include: a permanent integrated installation of seats such as that disclosed in my co-pending patent application, Ser. No. 07/869,737. filed on Apr. 10, 1892; placing a therapy pool contiguous or within a swimming pool; attaching the therapy pool to the wall of the swimming pool with a transition section as disclosed, for example, in U.S. Pat. No. 4,001,899; and the arrangement of depositing a removable partition comprising a therapy pool within the swimming pool as disclosed in U.S. Pat. No 4,240,165. However, a need exists for a conveniently adaptable retrofit seating unit for existing swimming pools that is reliable, economical and practical such as that provided by the present invention.

SUMMARY OF THE INVENTION

The present invention provides a novel, seating module for securing to the vertical interior wall at the shallow end of a swimming pool. The basic form of the module of the invention comprises a bench type seat unit on one or more contoured seats preformed, as by molding, as a unit and equipped with means to secure the module on the wall at the shallow end of a swimming pool. The form and design of the modular seat unit of the invention is so constructed and arranged that its use with the swimming pool structure involves essentially only the lowering into and securing the seat unit in an existing pool and affords a convenient, highly desirable accessory for a swimming pool. The unit comprises an option which a swimming pool purchaser is free to choose to add to the pool facility.

The seat module of the invention optionally, but preferably has a hydrotherapy spa capability. In this respect it includes one or more water jet openings or outlets within the contour of the seat cavity, i.e., hydrotherapy jets, at the back and/or sides of the seat contour, to introduce a hydrotherapy stream of warm water, preferably pressurized with air flow to produce water turbulence and supply therapeutic benefits. The seat module includes conveniently accessible, preferably individual controls for a seat occupant to adjust the water jet flow to the seat. The controls for the water and turbulence generating air supply are conveniently positioned such as by mounting them on a console contiguous to and accessible to the occupant of the seat. The controls may be interlocked with the water flow for the swimming pool and so as to draw from the filter pump, water heater, and the like, facilities already present in the system for the swimming pool.

The modular seating unit is preferably devised to accommodate a removable umbrella. For this purpose the seat console or bench includes a securing means for the umbrella which is highly advantageous to provide the seat occupant with shelter from the rays of the sun when such become intolerable to the seat occupant.

It is accordingly an object of the invention to provide a novel seating element which is lowered into a pre-existing swimming pool and is secured to the vertical wall and, optionally, also to rest on the pool bottom at the shallow end of a conventional swimming pool.

It is another object of the invention to provide a seating arrangement for lowering into the interior of a swimming pool which comprises a rest (seating) area within the swimming pool.

A further object of the invention is to provide a seating arrangement which incorporates a therapeutic capability of pressurized jets of water and turbulent air flow within the seat recess.

It is another object of this invention to provide a stable, in-pool seating means with therapeutic spa capability that is equipped with controls that are conveniently accessible to the seat occupant to regulate the flow of turbulent water jets introduced into the seat cavity against the body of the seat occupant.

It is a further object of the invention to provide a comfortably contoured lounge type modular seat unit devised to fit inside the swimming pool with the back of the seat module against the pool wall and wherein the seat opens into the swimming pool so as to be accessible to the user of the swimming pool while the swimmer is still in the pool.

The seat module of the invention may be installed as a single preformed unit by simply lowering it into the shallow end of a pro-existing swimming pool and securing it on the pool wall or alternatively by means that secures the module to both the wall and at the same time by resting the module on the swimming pool bottom.

A further and preferred object of the invention resides in the incorporation in the seat module, in conjunction with the seat feature that includes a spa-like capability and a means to accommodate a shelter umbrella.

Still a further object of the invention resides in the use of railings of the kind that are conventionally employed with a swimming pool, such as the structural tubing that is used for constructing swimming pool stair and ladder railings, to secure the seating module of the present invention.

Additional objects, advantages and capabilities afforded by the invention will become apparent from the accompanying drawing and the detailed description which follow:

DETAILED DESCRIPTION OF THE INVENTION

Figure 1:
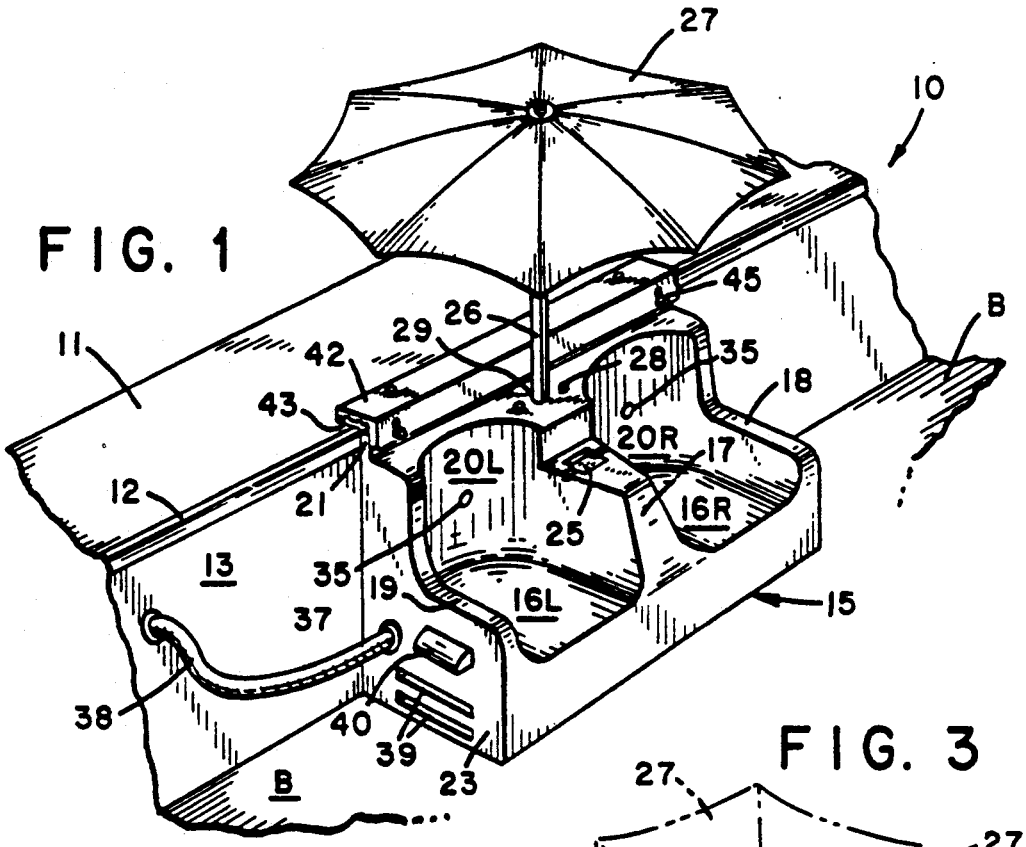
FIG. 1 is a perspective view of a seat module according to the invention in which the seating element is illustrated in conjunction with a segment of a perimeter wall and deck of a the swimming pool and illustrating a shelter umbrella over the seat area.
Figure 2:
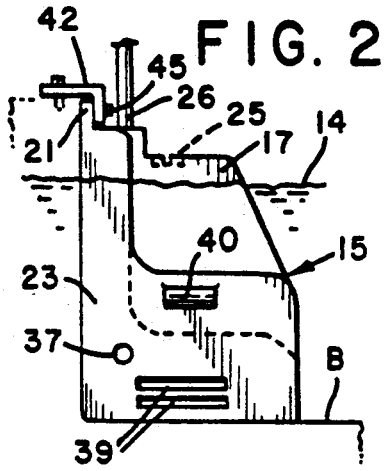
FIG. 2 is a side elevational view of the seat module of the embodiment of the invention shown in FIG. 1.
Figure 3:
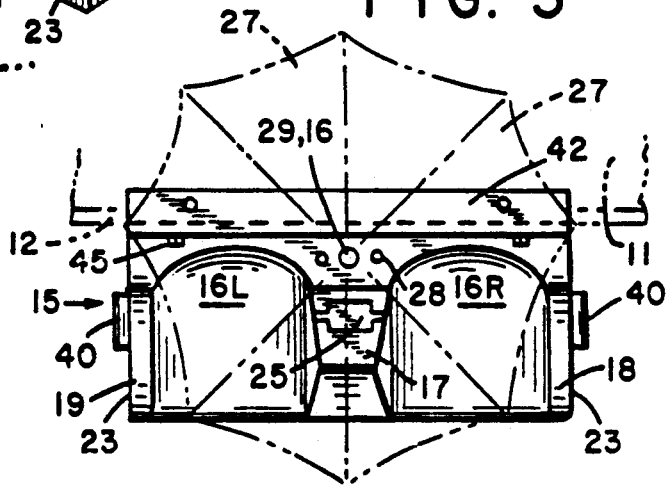
FIG. 3 is a top plan view of the seat module of the invention which is shown in FIGS. 1 and 2.
Figure 4:
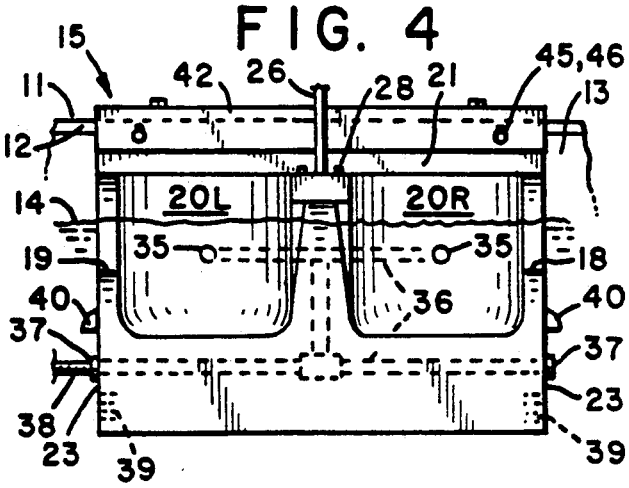
FIG. 4 is a front elevational view of the embodiment illustrated in FIGS. 1-3.

The swimming pool seating add-on module of the invention for use with existing pools, in its preferred embodiment, contemplates the provision of a preformed self-contained package which is lowered into the shallow end of a swimming pool and securely fastened on the vertical pool wall. Suitable mounting means include side rails which are secured to and comprise a part of the seat module with the ends of the side rails being received in a telescopic manner in mounting elements positioned on the contiguous swimming pool deck.

The seat module may comprise one or more seats. Preferably, a pair of seats are contained in the module. The seating module of the present invention affords a swimming pool owner, for a relatively modest cost the opportunity to add, as an option, a very desirable accessory, a seating unit which is easily detachably secured at the pool wall. In the installation of the modular unit of the invention, the seat module is simply lowered into the pool at the shallow end and secured. The securing operation requires a minimum or even no modification of the pre-existing pool structure to anchor the module in the pool. The add-on seat module of the invention may be used with pools of various construction including the one piece gunnite and those formed from a plurality of contiguously joined vertical wall panels. Typical swimming pools of the latter construction are those disclosed for example in U.S. Pat. Nos. 3,596,296, 4,661,247 and 4,797,957. Generally, pools of this kind include a flexible, water impermeable vinyl liner which covers the walls (that are formed of the contiguously secured modular wall panels) and the bottom of the swimming pool to define a water holding container. The seat module of the invention is devised to be positioned over the liner of such pools.

The addition of a seat component such as that provided by the invention at the shallow end of the swimming pool affords a highly advantageous feature to the pool which results in various substantial benefits over installations that lack this feature. The advantages of the add-on seat module to a swimming pool in accordance with the invention include:

- the ready availability of a seat for the swimmer to rest without the necessity of leaving the swimming pool.
- A relatively inexpensive and simplified means to introduce a therapeutic spa-like feature in combination with the swimming pool. enhancement of the conveniences offered by the swimming pool.
- efficiency in the operation of the therapeutic feature of the seat module which makes use of the utilities that are available with the swimming pool such as the warm water supply.
- provides a convenient, attractive, inexpensive inside-the-pool seating accommodation and optionally a therapeutic spa convenience.
- provides a convenient means for holding an umbrella to shelter the seat occupant from the sun's rays.
- The use of conventional swimming pool type railings are employed as compatible securing means for the module.

The seating device provided by the invention in essence introduces a seat accessory for adoption by pre-existing pool owners to afford a seating accommodation that is at all times accessible for immediate use by a pool occupant. The seat is desirable as a simple, yet important resting accommodation, especially for the elderly and also for making available a therapeutic benefit of a kind that is derived from exposure of the body to a turbulent warm water massage.

In accordance with the invention, suitable support means are provided at the wall, at the shallow end of the pool, with a minimum amount of modification of the preexisting pool structure. Suitable support means may comprise brackets on the deck or on the vertical wall or on the pool bottom. Preferably, the seat module is supported by side railings that are secured to the module and wherein the ends of the rails are inserted in sleeves anchored on the pool deck with the lower end of the seat module resting on the pool bottom. The support may include any various means known to those skilled in the art such as the recessed post mounting support system disclosed in U.S. Pat. No. 5,040,251 or surface mounted sleeves wherein an integrally formed flange on the sleeve is anchored such as by screws or lag bolts to the pool deck.

Referring now to the drawing and more particularly to FIG. 1, a segment 10 of a swimming pool with the seating module 15 is shown. The fragment of the swimming pool 10 of FIG. 1 comprises portions of the vertical perimeter wall 13, a floor or bottom B, a deck portion 11 and a coping element 12 forming the transitional piece at the corner of the vertical wall and the horizontal deck of a conventional swimming pool.

The seat module, which is constructed so as to facilitate its placement at the shallow end of a swimming pool, comprises first and foremost a seating facility which can be retrofitted with a minimum effort. The anchoring or securing of the basic seat module to the pool requires little or no modification of the swimming pool wall or other part of the swimming pool construction, depending upon the configuration and features of the existing pool. Preferably, the prefabricated modular seat unit of the invention includes, in addition to the securing mechanism, a hydrotherapy or spa capability wherein a turbulent air/water stream (optionally heated) can be introduced into the seat cavity.

Figure 5:
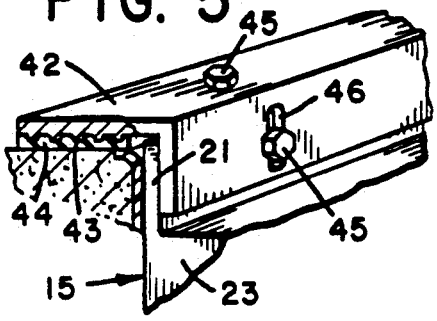
FIG. 5 is an enlarged fragmentary view of one form of an adapter for adjustably securing the seat module on the swimming pool wall at the coping and illustrating also supplemental anchoring means for locking the adapter.

As seen in FIG. 1, the module 15 incorporates contoured seat cavities, two of which are shown as 16L and 16R, with a console portion 17 between the seats. The console portion 17 includes various conveniences such as a beverage container holder 25, controls 28, and a fastening means or recess 29 to hole the handle 26 of a shade umbrella 27. The contoured seats may include arm rests 18 and 19 and seat module end panels 23. The module is also conveniently provided with handles 40 to facilitate installation and removal and side vents 29 to permit ready circulation of water through the underside of the seat module. Means for optionally, but preferably, introducing a therapeutic water/air stream into the seat recess is provided. Such means may utilize the existing pool water circulating system which is connected to the seat module via the conduit 38, at opening 37 through which water is propelled through the piping 36 into the seat cavity through openings 35. The seat module 15 may be secured in place by any suitable means such as a bracket 42 conforming, i.e., mating with the swimming pool coping with the module underside resting on the swimming pool floor. A weighting means for the module such as sand or water introduced into a compartment (not shown) internally contained in the module may serve to aid in anchoring the module, although the weight of the module is itself sufficient to hold the unit secure. The mounting adapter which is secured by vertically adjustable connection to the back panel 21 of the module 15 is devised to seat on the pool coping and preferably includes a non-skid insert 43 and bolts 45 in slotted recess 46 and may include also one or more securing screws S (See FIG. 5) which anchors the bracket 42 on the coping 12. The construction of bolts 45 in the slotted recess 46 allows for vertical tolerance for the module so that the module at all times rests securely on the pool bottom when bolts 45 are tightened.

The module side panels 23 are devised to be trimmed, when appropriate, at the lower end to conform to the curve or taper of the pool bottom, i.e., modified from a horizontal bottom, to follow the contour of the swimming pool bottom.

It is thus seen, upon installation of the modular accessory of the invention, the seat opening faces into the swimming pool and is secured in place resting on the pool coping using the adaptor such as that referred hereinabove by the reference numeral 42 or by fastening the seat module directly to the pool coping or vertical wall. Because of the adjustment in the elevation tolerance effected by the slotted opening 46 the module 15 is position so as to be secured at the top and so as to rest firmly on the swimming pool bottom, weighted with sand or water in an internal compartment (not shown) of the module, if desired. The adapter 42, particularly when supplemented with anchoring screws S, securely grips and holds the top of the module which provides a solid, secure hold against dislodgement even when substantial forces tend to cause the module to be moved.

While a suitable module with a single seat is also contemplated, preferably the seat unit is provided with conversation-enhancing-between-bathers, paired seats, feature comprising a horizontal seat portions 16L and 16R and vertical back portions 20L and 20R, respectively, to afford a comfortable, reclining seat for pool users. The seat module 15 includes a console portion 17 which accommodates suitable controls for the hydrotherapy fluid flow and a means to secure a shelter umbrella. The inclusion of a means to secure a shelter umbrella is important particularly to safeguard against the harmful affects of of the sun's rays. If the seat module includes a source of heated water and/or air/water mixture jets 35 are provided with controls 38 to vary the quantity and intensity of the therapeutic liquid flow.

The seat cavities are immersed in the pool water so that the water level 14, when an adult person is reclining in the contoured seat of the modular unit that is installed in the shallow end of the pool, i.e., at about a three foot depth, reaches to about the lower chest of the seat occupant.

Suitable holding means are provided in the console 17 such as a socket opening 29 to accommodate an umbrella 27 to shelter a seat occupant from the rays of the sun. The console segment 17 may also be used to locate additional add-on features or elements such as the beverage container holding recess or ash tray.

Figure 6:
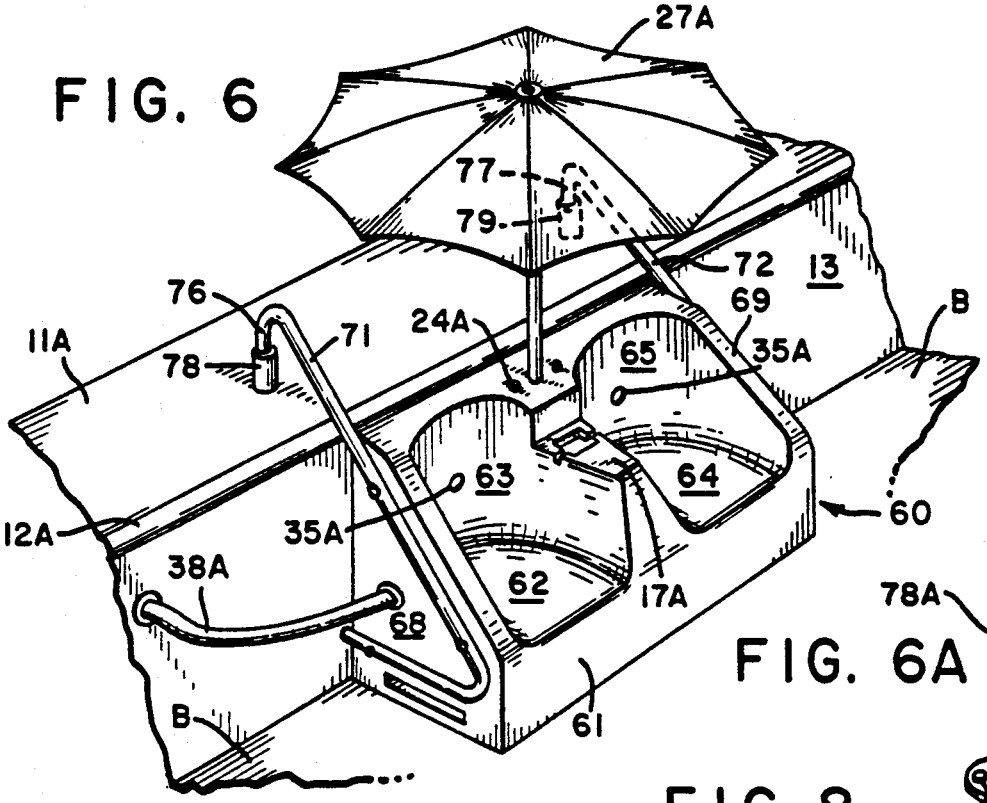
FIG. 6 is a perspective view of an alternative (and preferred because of its relative simplicity of installation) embodiment of the retrofit seat module of the invention shown secured in position on the deck contiguous to the vertical wall and resting on the swimming pool bottom.
Figure 6A:
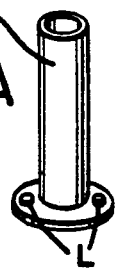
FIG. 6A is a perspective view of a deck surface mounting adapter devised to receive the mounting rail end.
Figure 6B:
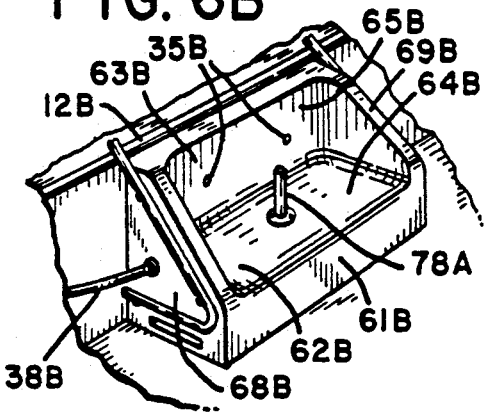
FIG. 6B is a perspective view of an alternative bench-type seat as distinguished from the contoured individual-type seats of the kind shown in FIG. 6.
Figure 8:
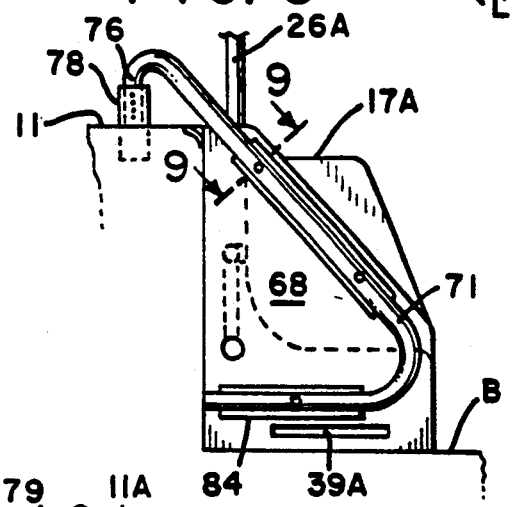
FIG. 8 is a side elevational view of the seat module taken along line 8—8 of FIG. 7.
Figure 7:
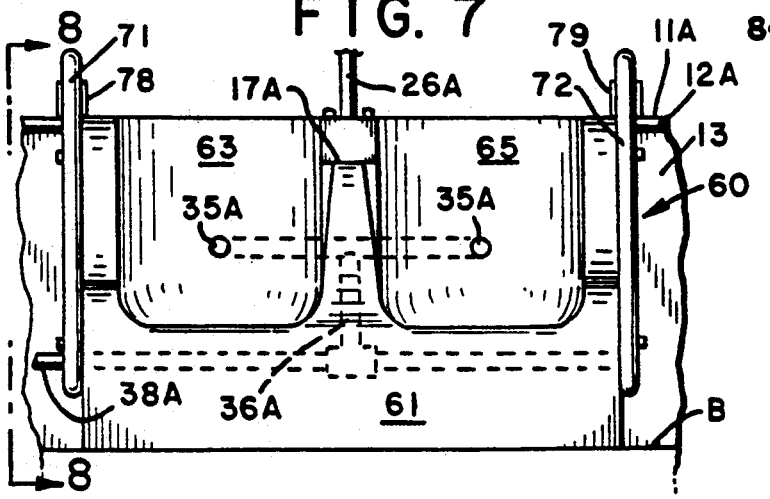
FIG. 7 is a rear elevational view of the seat module of the invention shown in FIG. 6.

Referring to the alternative and preferred embodiment of FIG. 6–10, a seat module 60, generally the configuration described by reference to FIGS. 1–5 is shown. The unit of FIGS. 6–10 differs from the embodiment of FIG. 1 in the utilization of side hand rails 71 and 72 and by the manner in which the module is secured to the swimming pool wall. The tubular rails 71 and 72, which are in dimension and material, similar to those that are conventionally used at swimming pool sites for use with various accessories such as stair and ladder railings, barriers, etc., secured on the module and are delivered as a package with the seats to the pool site. In the installation, the depending ends 76 and 77 of the rails 71 and 72 respectively are inserted into suitable rail mounting openings 78 and 79. The openings in the mounting 78 and 79 are of a diameter to securely receive (in a close telescoping fit) the relatively smaller diameter of the rail ends 76 and 77. Any suitable means may be employed to secure the ends of the rails 76 and 77 of the rails 71 and 72. One mounting means being that disclosed in U.S. Pat. No. 5,040,251. Alternatively, in lieu of drilling the relatively large openings needed to sink into the pool deck the adapters which receive the the depending top ends of seating module side rails, a surface mounted adapter 78A may be secured on the deck surface. Such a surface mounted adapter is shown by reference to FIG. 6A. The adapter of the kind shown in FIG. 6A is appropriately secured on the pool deck such as with lag screws L. The sleeves 78 and 79 (and 78A) that receive the downward depending top ends 76 and 77, respectively, of the seat module side rails may be provided with height adjustment means that comprise a plurality of mating holes in the sleeve and in the rail ends to permit the locking of the rails at different heights through movement of the locking pins (see FIG. 10).

Figure 9:
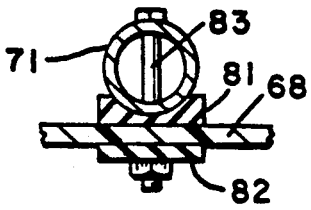
FIG. 9 is a detail view taken along line 9—9 of FIG. 8.
Figure 10:
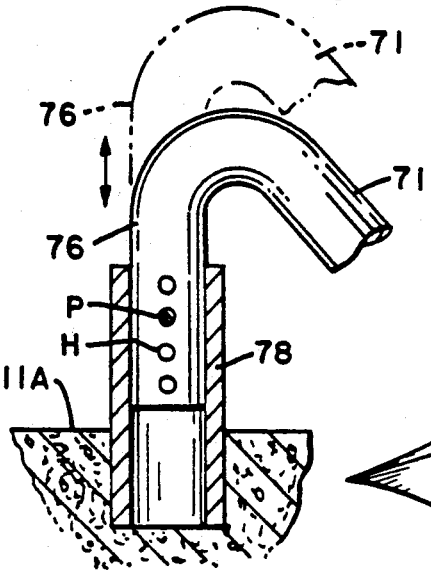
FIG. 10 is an enlarged detail view or the securing portion of the seat side rail and pool deck socket adapter to receive the seat rail end.

Suitable means to lend strength and rigidity to the module may be employed such as by the use of the strip adapters 81 and 82 that are sandwiched between the module 60 and the rails 71 and 72 to more firmly hold the rail members 71 and 72 to the sides 68 and 69 of the seat module 60 using appropriate fasteners such as the bolts 83 (see FIG. 9). A similar fastening adapter 84 is shown for the horizontal lower part of the rail 71.

The deck 11, coping 12, vertical wall 13, pool bottom B, console 17, controls 28 and umbrella handle 26 for the umbrella 27 of the embodiment of FIGS. 6–10 are referred to by the use of similar reference numerals as those in the embodiment of FIGS. 1–5 except for the use of the letter A accompanying the numerals and function in essentially in the manner described with reference to FIGS. 1–5.

Figure 11A:
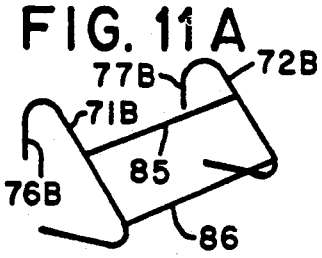
FIG. 11A is a schematic illustration in perspective of the frame portion of the seat support on which the molded seat is mounted to form the modular unit shown in FIG. 11.
Figure 11B:
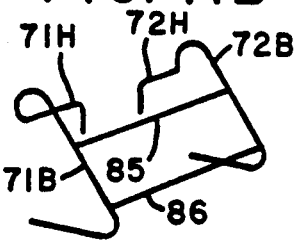
FIG. 11B is a schematic illustration in perspective of the frame portion of a seat module wherein the top ends, of the side rails of the module that are to be secured by insertion in openings formed on the pool deck, are bent inwardly so as to be accommodated in pre-existing openings in the deck that have been provided to hold the railings of conventional swimming pool ladder.
Figure 11:
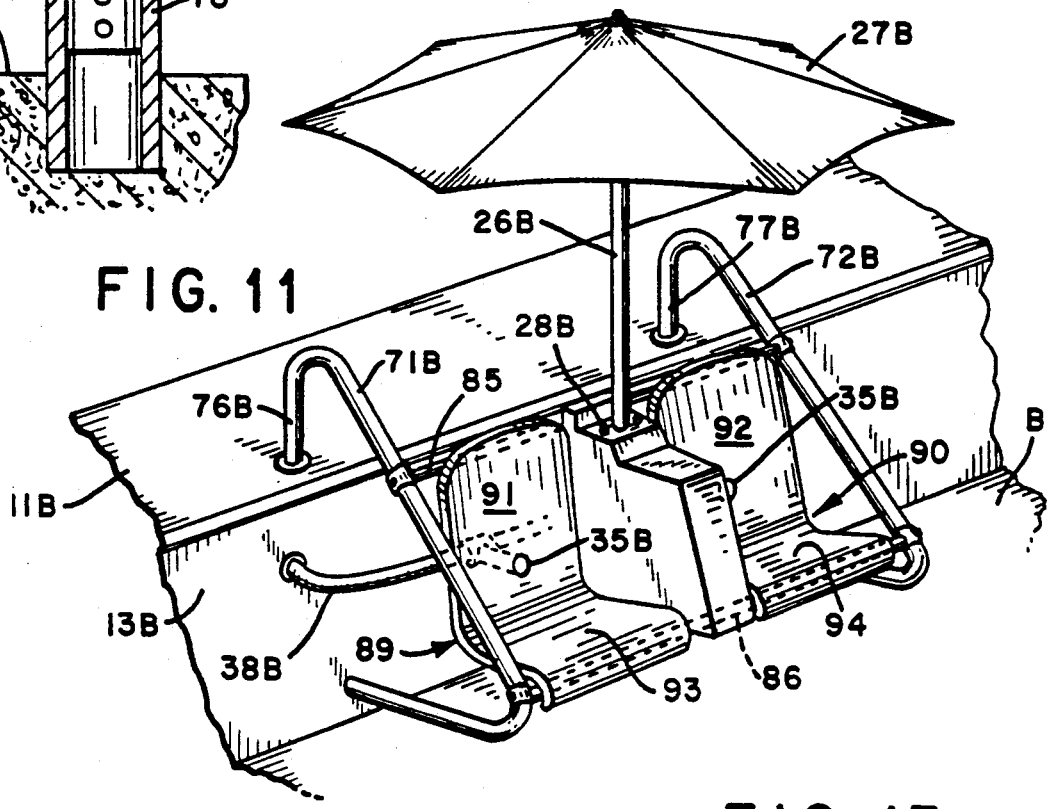
FIG. 11 is a perspective view of still another alternative embodiment of the seat module of the invention.
Figure 12:
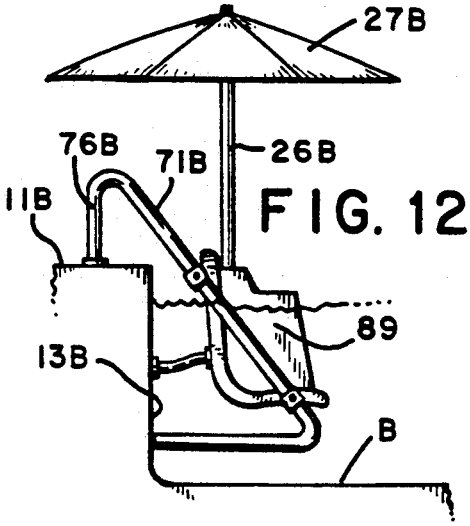
FIG. 12 is a side elevational view of the embodiment illustrated in FIG. 11.
Figure 13:
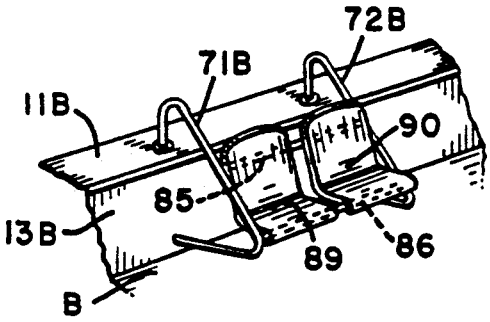
FIG. 13 illustrates a perspective view of still another more simplified seat module in which the module omits therapeutic capability and sun shading umbrella feature.

An additional alternative, relatively even more simplified embodiment is illustrated in FIGS. 11–13. This unit comprises a seat mounting frame (see FIG. 11*a*) on which the seats are secured to provide a prefabricated module which is then brought on to the pool site and attached at the shallow end of the pool in the manner referred to in the embodiment described in FIGS. 6–10.

As seen by reference to FIG. 11*a*, the seat frame comprises side rails 71B and 72B connected by a horizontal seat back mounting member 85 and horizontal bottom seat support member 86. The seats (not shown) are of a conventional form such as those illustrated as 89 and 90 in FIG. 11 and FIG. 13, preferably molded from a synthetic plastic composition in the form of a lounge seat. The synthetic plastic composition used in molding the seats should preferably be of a nature which is resistant to the sun's rays and the pool's chemicals. The seats comprising the seat back 91 and 92 to the horizontal frame member 85 and at the seat bottoms 93 and 94 to the lower horizontal member 86. The assembled modular arrangement mounted on the frame 11*a* is then lowered at the shallow end of the pool and secured in a manner such as that described by reference to FIGS. 6–10 wherein the rail end members 76B and 77B are inserted (telescoped) into complimentary sockets formed in the horizontal pool deck 11B.

Shown by reference to FIG. 11*b* is an alternative embodiment which differs from that of FIG. 11*a* in that the rail ends 76*c* and 77*c* at the top of module side rails, which are to be inserted into the deck adapter openings, are bent inwardly, as shown at 71H and 72H so that the distance between 76*c* and 77*c*, i.e., between the module sides, is relatively narrower. As thus configured, the depending inwardly bent upper ends of the module side rails can be accommodated in pre-existing openings which may have been formed in a pool deck to receive a conventional swimming pool ladder.

The embodiment of FIG. 11 includes a hydrotherapy water/air source option furnished through the conduit 38B and exiting at 35B into the seat backs 91 and 92. The parts referenced by numerals in FIGS. 11–13 followed by the letter B and C comprise essentially elements in construction as well as function as those elements with corresponding reference numerals in prior described embodiments.

The embodiment of FIG. 11 is provided also with suitable adjustable level securing means such as the rail and rail socket mount securing means 76, 77 and 78, 79 which have been referred to by reference to embodiment of FIGS. 6–10, to assure the substantial immobilization of the seating module when it is fastened in position.

Referring to the embodiment of FIGS. 14–17, an add-on seat module devised to be secured and disposed so that, when fastened in position, the back of the module is flat against the vertical swimming pool wall with the bottom of the module being spaced from the swimming pool bottom. This embodiment offers the advantage of eliminating any "entrapment" spaces between the seat module and the swimming pool wall or the swimming pool bottom which may create a hazard, for example, to a person's body or limb or hold debris.

Figure 14:
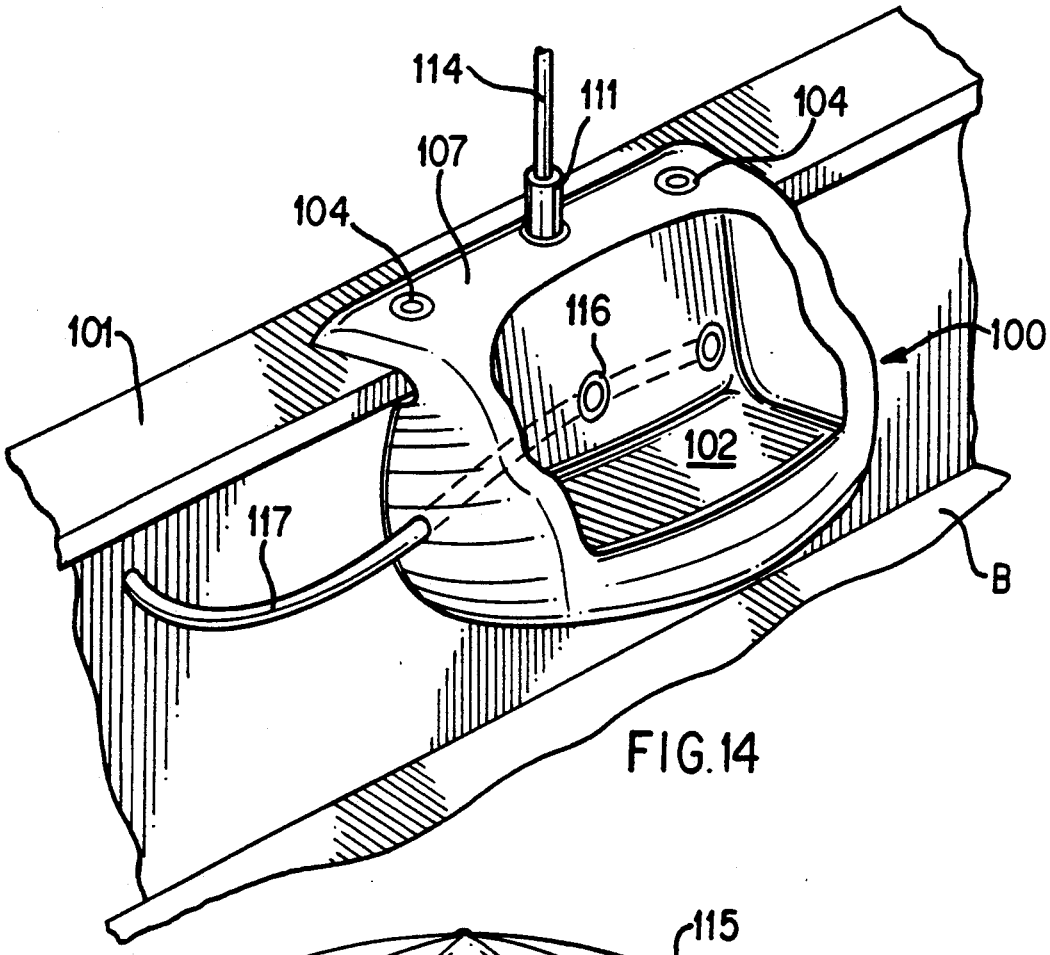
FIG. 14 is a perspective view, and FIG. 15 a side elevational view, of another embodiment of the add-on seat module according to the invention.
Figure 15:
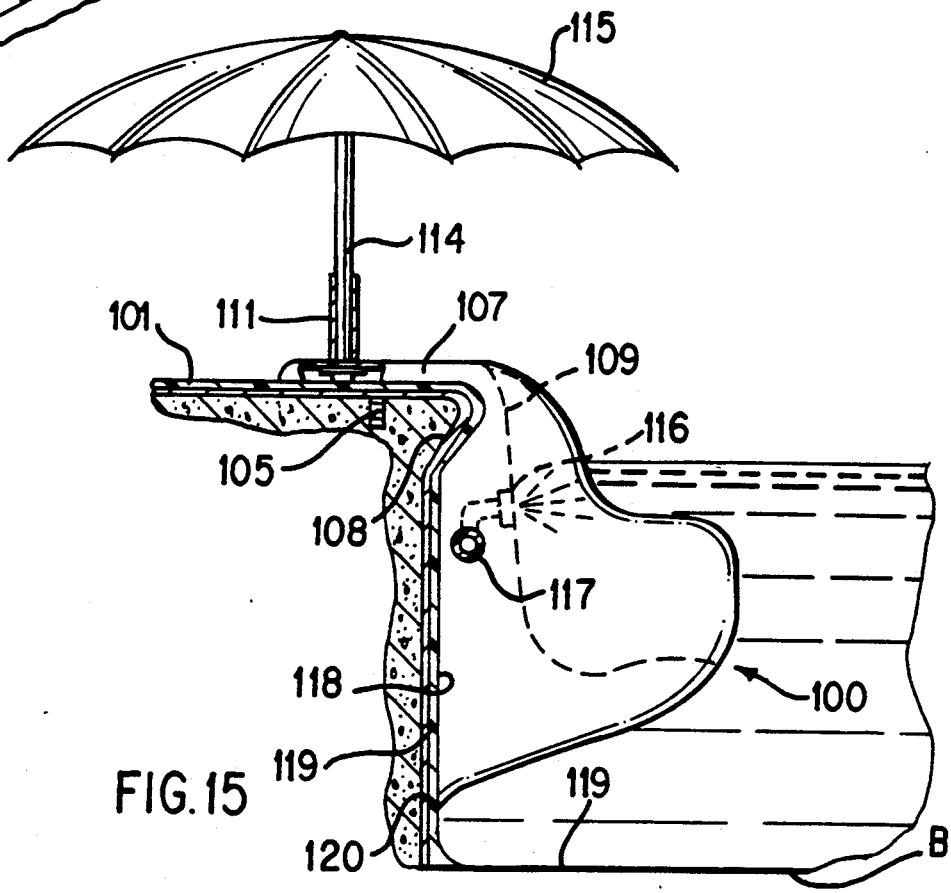
Figure 16:
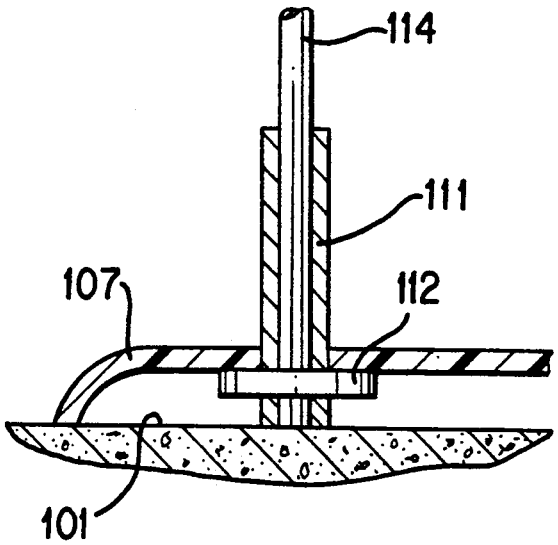
FIG. 16 and FIG. 17 are enlarged detail views of the embodiment shown in FIGS. 14 and 15
Figure 17:
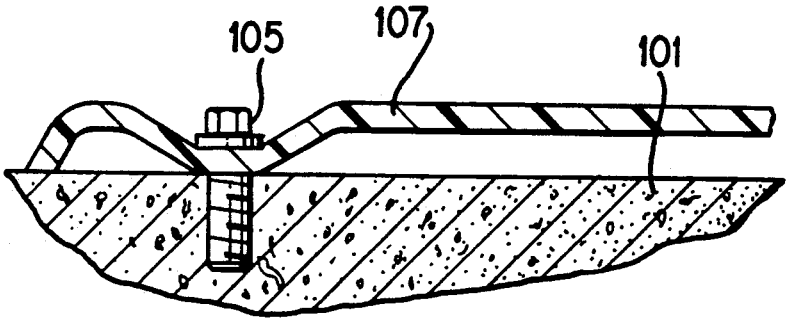

As seen by reference to FIGS. 14 and 15, a module 100, preferably provided with a double seat 102 is secured by a flange 107 integrally formed at the top of the module 100 by attaching the flange 107 to the swimming pool deck 101 by suitable fastening means, such as fasteners 105. As shown in detail in FIG. 17, he fasteners 105, such as lag screws, are inserted through openings 104 in the flange 107. It will be apparent that other suitable means for securing the flange 107 on the swimming pool deck may be employed. The bottom of the flange 107 and the top rear of the module is appropriately contoured at 109, as shown in cross section in FIG. 15, so as to have sufficient clearance for copings of varying protrusions. A shelter umbrella adapter 111 of the kind shown as 78 in FIG. 6 or 78A in FIG. 6A, suitably formed or secured on the flange 107 is devised to appropriately hold an umbrella 115 in position.

Suitable means such as a reinforcing washer or plate 112 which is bonded to or otherwise secured to the underside of the flange 107 may be employed to lend improved rigidity and strength to the umbrella adapter 111.

One or more openings 116 for introducing a therapeutic stream of water via the conduit 117 in the manner described heretofore by reference to the elements 35 and 38, respectively, in the embodiment of FIG. 1 may also be utilized in this embodiment.

As seen by particular reference to FIG. 15, the seat module 100 is lowered into the swimming pool so that the underside of the flange 107 rests on the pool deck and the vertical back side 118 of the seat module 100 rests flush against the vinyl liner 119 which covers the vertical wall 120 and the bottom B of the swimming pool.

Suitable valve means and safety shut off controls for governing water flow quantity, for turbulence generation, for temperature adjustment, and the like, all of which are known and available in the art may be incorporated to service the hot water and air turbulence generating air into the seat recesses. Such controls optionally, may interlock with, and override, the swimming pool controls (not shown) for similar functions attendant to the swimming pool.

While the invention as described in detail and shown in the accompanying drawings present a preferred embodiment, it will be understood that the invention may be modified in various additional details without departing from the spirit of the invention.

What is claimed is:

1. A swimming pool occupant seat modular unit comprising a molded seat portion and a seat back portion which portions are a fixed integrated part of the modular unit and wherein the modular unit includes side portions, each having a vertical rear edge, and wherein said modular unit to be lowered into a shallow end of a pre-existing swimming pool in overlapping relation to a pre-existing, planar swimming pool sidewall such that said rear edges abut said sidewall, said modular unit being provided with flange means to securely fasten the modular unit against dislodgement over said vertical swimming pool sidewall in a position such that the seat portion, side portions and back portions are located and secured in a fixed position below a swimming pool water level and such that a top of the modular seat unit does not extend substantially above a peripheral deck of the swimming pool and, said flange means being mounted across a top edge of the unit and adapted to be secured to a deck of the swimming pool.

2. The modular seat unit of claim 1 in which a means is provided to conduct a hydrotherapy water flow derived from a water circulating system of the swimming pool into the molded seat portion.

3. The modular unit of claim 1 wherein the seat comprises a molded part integrating seat side panels, said module devised to rest on the swimming pool bottom.

4. The modular unit of claim 2 wherein the modular unit contains, as an integral part, seat side panels.

5. The modular unit of claim 4, including a pair of seats and interposed therebetween a console portion to house controls for a hydrotherapy water flow.

6. The modular unit of claim 5 provided with a holding means positioned between the seats to hold a sun shielding umbrella.

7. The modular unit of claim 1 wherein said flange means to securely fasten the modular unit against dislodgement on the deck of the swimming pool comprises a longitudinal adapter that is attached at the top edge of the modular unit.

8. The modular unit of claim 7 wherein a front portion of the module is devised to rest on a swimming pool bottom.

9. The modular unit of claim 7 wherein the adapter is provided with a vertical adjustment securing means to allow for tolerance for the securing means.

10. An add-on swimming pool occupant seat accessory comprising a premolded unit encompassing a pair of side-by-side disposed molded seats, said unit being devised to be lowered into a shallow end of a pre-existing swimming pool, said molded unit being provided with means to fixedly secure the unit against dislodgement over and against a pre-existing swimming pool wall in a position such that the seats are disposed below a swimming pool water level and such that the modular unit, when positioned over a swimming pool wall, does not extend above a peripheral deck of the swimming pool.

11. The modular unit of claim 10 in which a console portion is disposed between the seat pair.

12. The modular unit of claim 11 wherein the console is provided with means thereon to secure a sun shielding umbrella.

13. The modular unit of claim 10 in which a means is provided to conduct a hydrotherapy water flow derived from a water circulating system of the swimming pool to the molded seats.

* * * * *